United States Patent [19]

Hashimoto et al.

[11] 4,411,543

[45] Oct. 25, 1983

[54] SELF-FEEDING MECHANICAL PENCIL

[75] Inventors: Junichi Hashimoto; Tadayuki Miyagi, both of Tokyo, Japan

[73] Assignee: Pentel Kabushiki Kaisha, Tokyo, Japan

[21] Appl. No.: 198,281

[22] Filed: Oct. 17, 1980

[30] Foreign Application Priority Data

| | | | |
|---|---|---|---|
| Oct. 29, 1979 | [JP] | Japan | 54-139645 |
| Dec. 28, 1979 | [JP] | Japan | 54-183285[U] |
| Dec. 28, 1979 | [JP] | Japan | 54-183286[U] |
| Jan. 24, 1980 | [JP] | Japan | 55-7356[U] |
| Jan. 29, 1980 | [JP] | Japan | 55-9073[U] |
| Feb. 28, 1980 | [JP] | Japan | 55-25226[U] |
| Mar. 31, 1980 | [JP] | Japan | 55-43037[U] |
| Apr. 25, 1980 | [JP] | Japan | 55-57949[U] |
| May 31, 1980 | [JP] | Japan | 55-75437[U] |
| Sep. 25, 1980 | [JP] | Japan | 55-136270[U] |
| Sep. 25, 1980 | [JP] | Japan | 55-136271[U] |

[51] Int. Cl.[3] ..... B43K 21/16

[52] U.S. Cl. ..... 401/53; 401/65

[58] Field of Search ..... 401/53, 65, 67, 80

[56] References Cited

U.S. PATENT DOCUMENTS

| | | | |
|---|---|---|---|
| 2,523,568 | 9/1950 | Halverson | 401/65 |
| 3,424,535 | 1/1969 | Schischkow | 401/53 |
| 3,514,211 | 5/1970 | Hashimoto et al. | 401/53 |
| 3,804,536 | 4/1974 | Torii et al. | 401/65 |
| 3,850,531 | 11/1974 | Ackermann | 401/53 X |
| 3,864,046 | 2/1975 | Butka | 401/53 |
| 3,899,256 | 8/1975 | Mitsuya | 401/65 |
| 4,180,339 | 12/1979 | Katz | 401/67 |

FOREIGN PATENT DOCUMENTS

| | | | |
|---|---|---|---|
| 2837586 | 3/1980 | Fed. Rep. of Germany | 401/80 |
| 49-125123 | 11/1974 | Japan . | |
| 50-926 | 1/1975 | Japan . | |
| 52-152327 | 12/1977 | Japan . | |
| 54-149329 | 10/1979 | Japan . | |

*Primary Examiner*—Edward M. Coven

*Attorney, Agent, or Firm*—Wenderoth, Lind & Ponack

[57] ABSTRACT

A mechanical pencil is of the type in which a writing lead can be advanced by the extent to which the lead has been worn without changing the writing posture of the pencil. The pencil has a lead holder slidably mounted lengthwise within a casing, a lead guide tube slidably mounted within the casing together with the lead holder, a lead feeding device mounted movably within the casing for feeding the lead into the lead guide tube, and a device mounted movably within the casing for locking rearward movement of the lead feeding device. The lead can be advanced by merely releasing a writing pressure which was applied by the writing tip onto a piece of writing paper.

16 Claims, 19 Drawing Figures

SELF-FEEDING MECHANICAL PENCIL

BACKGROUND OF THE INVENTION

The present invention relates in general to a writing instrument, and more particularly to a mechanical pencil of the kind in which a writing lead can be advanced by the extent to which the lead has been worn due to a writing operation without changing the posture of the writing instrument.

Writing instruments of this type are known to incorporate a spring device or the like which must be actuated to bias a lead guide device towards a writing tip of the instruments. Namely, a writing operation is carried out with the lead guide device being pressed onto a writing surface such as a paper by means of the spring device. Accordingly, it is likely that the lead guide device, generally a tubular member, catching the writing surface to thereby damage the writing material and achieve an undesirable writing operation.

SUMMARY OF THE INVENTION

A principal object of the present invention is to provide an improved mechanical pencil of the kind in which a writing lead can be advanced by the extent to which the lead has been worn, without changing the writing posture of the pencil.

Another object of the present invention is to provide a new mechanical pencil of the type referred to which can absorb mechanical shock imparted to the pencil body and excessive pressure applied to the writing lead during a writing operation, thereby ensuring a reliable writing operation.

Another object of the present invention is to provide an improved mechanical pencil of the type referred to which permits a ready disengagement of the lead and then a subsequent supply of a new lead.

Another object of the present invention is to provide a mechanical pencil of the type described which can avoid an excessive advancement of the lead, the excessive advancement being likely to occur when an abnormal shock or vibration is accidentally applied to the pencil.

Another object of the present invention is to provide a writing instrument of the kind referred to which permits a regular advancement of the writing lead by merely releasing the connection between a writing tip of the pencil and a writing material, the two having been in contact for the purpose of writing.

A further object of the present invention is to provide a new mechanical pencil of the kind described which permits a regular advancement of the lead by moving the pencil in the lengthwise direction thereof.

Another object of the present invention is to provide a new mechanical pencil of the kind referred to which ensures continuous, reliable and easy supply of additional writing leads without any incorrect manipulations.

An additional object of the present invention is to provide a new mechanical pencil of the type described which can be manufactured readily and economically without substantial labor or difficulty.

Briefly, a mechanical pencil according to the present invention comprises a substantially cylindrical casing, a lead guide tube mounted slidably lengthwise within the casing for slidably receiving and supporting a lead, clamp means slidably clamping the lead, lead advancing means mounted slidably lengthwise within the casing, and locking means mounted movably within the casing for locking the lead advancing means.

Other objects, advantages and features of the present will become apparent upon reading the following specification and referring to the accompanying drawings in which similar reference characters represent corresponding and like parts in each of the various views.

BRIEF DESCRIPTION OF THE DRAWINGS

FIGS. 1, 2 and 3 are sectional views of a mechanical pencil embodying the present invention, in which FIGS. 2 and 3 illustrate operation of the pencil.

DETAILED DESCRIPTION OF PREFERRED EMBODIMENTS

Figure 1:
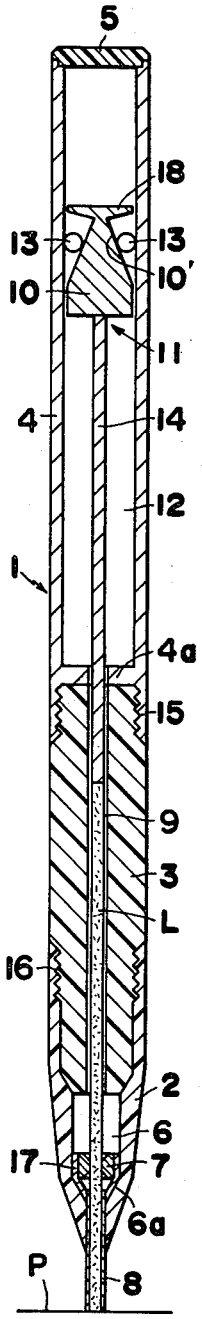

Certain terminology will be used in the following description for convenience in reference only and will not be limiting. The words "upwardly", "downwardly" will designate directions in the drawings to which reference is made. The words "forwardly" and "rearwardly" will refer to directions relative to a writing tip and a rear end, respectively, of the pencil. The terminology will include words above specifically mentioned, derivatives thereof and words of similar import.

Figure 2:
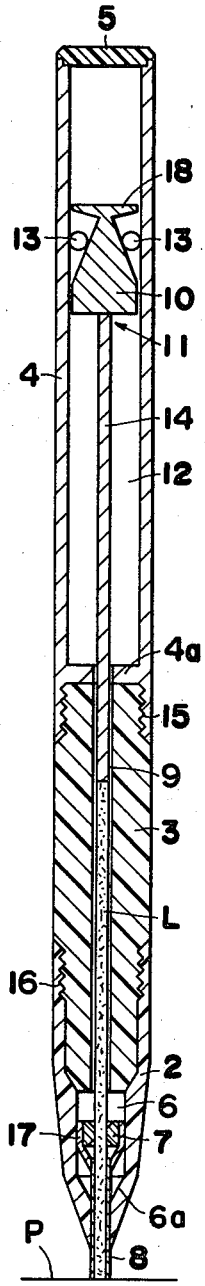
Figure 3:
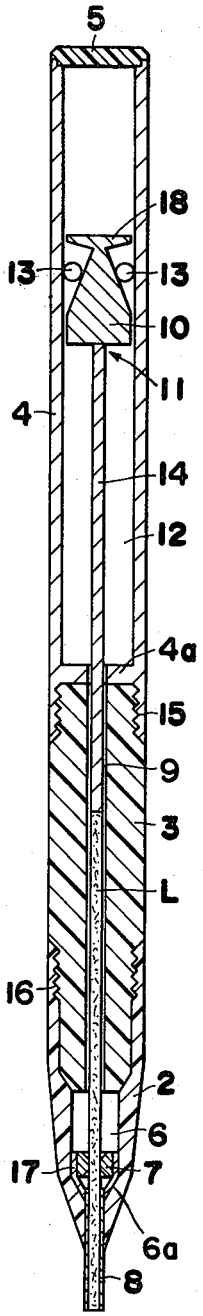

Referring first to FIGS. 1 through 3, a mechanical pencil has a barrel body of plastic material, which is generally indicated by reference numeral 1, generally a forward end member 2, middle member 3 threadedly engaged with the forward end member 2 at 16, rear end member 4 threadedly engaged with the middle member 3, and an end cap 5 for closing the rear end of the member 4. The forward end member 2 has a bore 6 within which a lead holder 7 for slidably holding the lead is mounted slidably lengthwise within the bore 6, and a lead guide tube 8 is slidably mounted within a forward portion of the bore with its forward end projecting forwardly from the forward end portion 2. The middle member 3 has an axial through-hole 9 for freely securing therein a lead L, the hole 9 being axially aligned with the bore 6 and the guide tube 8. The rear end member 4 is substantially tubular with a space 12 of substantially equal diameter throughout the entire length thereof. A guide ring is integrally formed at the forward end portion of the rear end member 4. Within the space 12 is slidbly disposed a lead clamp 11 which has a rod 14 projecting into the through-hole 9 of the middle member 3 to contact with the lead L, and slide member 10 having a tapered circumferential end 10' and a brim 18 integrally formed at the tapered end. Within the space 12 is also mounted a locking device 13 which includes rotary bodies such as balls or rollers positioned between the inner surface of the rear end member 4 and the tapered surface 10' of the slide member 3 so that the balls 13 can lock and prevent rearward movement of the lead clamp 11. Though the illustrated embodiment shows threaded engagements 15, 16, the elements 2, 3, 4 may be connected by press-fit arrangements.

For the purpose of understanding the invention more clearly, the operation of the pencil will be described. When the pencil is placed in a writing posture as illustrated in FIG. 1, the barrel body 1 is pressed downwardly against a writing surface P such as a piece of paper. This applied pressure functions to press in the reverse direcion, i.e. upwardly, the lead L as well as the lead clamp 11 since the lead L is forcibly against the paper. When this upward pressure is delivered to the lead clamp 11, the latter is urged upward initially, but immediately thereafter is wedged by the cooperation of the tapered end 10', locking device balls 13 and the inner surface of the rear end member 4, since the balls 13 are lowered by their weight until they contact the tapered end 10' and the inner surface of the rear end member 4. Thus the lead clamp 11 as well as the lead L is in a fixed position relative to the barrel body 1. This means that a downward pressure imparted on the barrel 1 presses the lead L downwardly against the paper P to thereby enable the pencil to be in a writing condition. When writing is continued, the lead L is worn out while the lead guide tube 8 slides rearwardly or upwardly relative to the barrel 1 with the lead holder 7 lightly clamping the lead L, as illustrated in FIG. 2. When the pencil is lifted up to permit the lead guide tube 8 to disengage from the paper P after writing is finished, the force applied to the lead clamp 11 and the lead is completely released, and then the aforementioned wedging, namely the engagement of the balls 13 with tapered end 10' and the inner surface of the rear end member 4 also is released. In this instance, no external force is applied to any of the lead guide tube 8, lead clamp 11, balls 13 and lead L except for their own weight; and the lead guide tube 8 as well as the lead L drop by their own weight such that the lead guide tube 8 slides down along the bore portion 6a until the rear portion 17 of the lead guide tube 8 contacts with the bore portion 6a, after which the lead guide tube 8 does not slide down any further, as shown in FIG. 3. At the same time, since the aforementioned wedging is released, the radial force of the balls 13 against the inner surface of the rear end member 4 is released to permit the lead clamp 11 as well as the balls 13 to move downwardly by their own weight until the downward movement of the lead guide tube 8 stops. This is illustrated in FIG. 3. When another downward force is applied to the barrel 1 so that the lead is pressed against the paper, the wedging action as described is produced again to place the pencil into a writing position. Thus, the lead is advanced by the extent to which the lead has been abraded or worn, without changing substantially the writing posture of the pencil, by merely disengaging the contact between the writing tip of the pencil and the paper.

When balls 13 are made of a metal such as steel, it is preferred that the rear end member 4 be made of steel so as to facilitate the rolling action of the balls 13 without causing wear on the interior of the rear end member 4. The brim 18 has a function to prevent the balls 13 from separating from the lead clamp 11.

Figure 4:
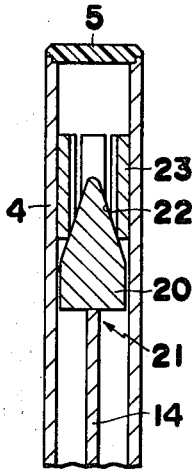
FIG. 4 is a sectional view of a part of a mechanical pencil of a modification of the structure of the pencil shown in FIGS. 1, 2 and 3.

FIG. 4 shows a modified structure of the locking device 13 and the tapered slide member 10 shown in FIGS. 1 through 3, and the other elements and structure of the modification of FIG. 4 are quite similar to those of FIGS. 1 through 3, so that a detailed description will not be made with reference to such similar elements. In FIG. 4, a tapered slide member 20 of a lead clamp 21 has a tapered end 22. A locking device which corresponds to the locking device of balls 13 of FIGS. 1–3 is constructed with a plurality of elongated plates 23 circumferentially aligned within the rear end member 4. It will be readily understood that the structure of FIG. 4 also permits easy releasing of the wedging action as well as smooth lengthwise movement of the lead clamp 21 within the rear end member 4, while the desired wedging action by the plates 23 can be expected.

As described above, the mechanical pencil according to the present invention permits a smooth and successive advancement of the lead by the mere operation of lifting the pencil slightly after the lead has been contacted with the paper for a writing operation. Further, the lead guide tube 8 can be smoothly retracted, and a desired writing operation can be expected.

Figure 5:
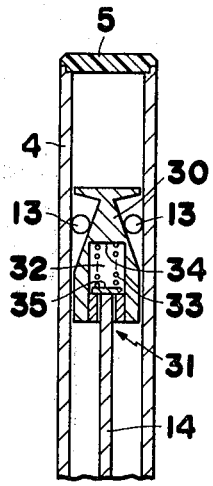
FIG. 5 is a sectional view of a mechanical pencil according to another embodiment of the present invention.

FIG. 5 shows a further modification of the pencil in connection with the structure of the slide member, which is referred to at 10 in FIGS. 1 through 3, while the locking device 13 is understood to be quite similar with that of FIGS. 1–3. In FIG. 5, a tapered slide member 30 which has a contour substantially similar with that of the slide member 10 of FIGS. 1–3 has a bore 32 for securing therein a coiled spring 33 one end of which is contacted with a bore wall 34 while the other end of which is connected with the bar 14 of a lead clamp 31 through an end plate 35 which is connected to the rear end of the bar 14. The bar 14 is biased downwardly by the resilient force of the spring 33. It is preferred that the spring 33 be made to have a resilient force which is greater than a usual or normal writing force and small enough not to cause breakage of or damage to the lead L. Employment of the spring 33 between the rod 14 and the slide member 30 as described can avoid such disadvantage as lead breakage, particularly when an excessive shock is imparted to the elements such as lead guide 8 (shown in FIG. 1) in case that, for example, the pencil is accidentally dropped on the floor or an excessive writing force is applied to the lead. The excessive shock can be absorbed by the spring 33.

Figure 6:
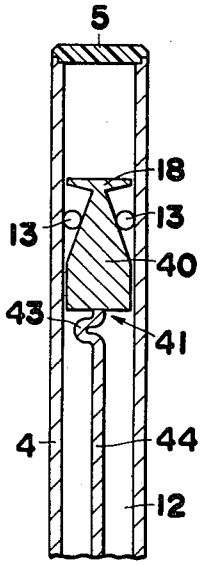
FIG. 6 is a sectional view of a part of a mechanical pencil, showing a further modified structure.

For the purpose of absorption of such excessive shock, the lead clamp can be formed as illustrated in FIG. 6, in which a lead clamp 41 has a curved portion 43 on the rear portion of the rod 44. The rod 44 is connected with a tapered slide member 40 in a manner similar to that of the previous embodiments. It will be understood that the curved portion 43 corresponds to the spring 33 of FIG. 5 and has a resiliency greater than a usual writing force and small enough not to cause lead breakage. The other structure and function of FIG. 6 are quite similar to those of the previous embodiment and will be understood readily, such that a detailed description thereof need not be made.

Figure 7:
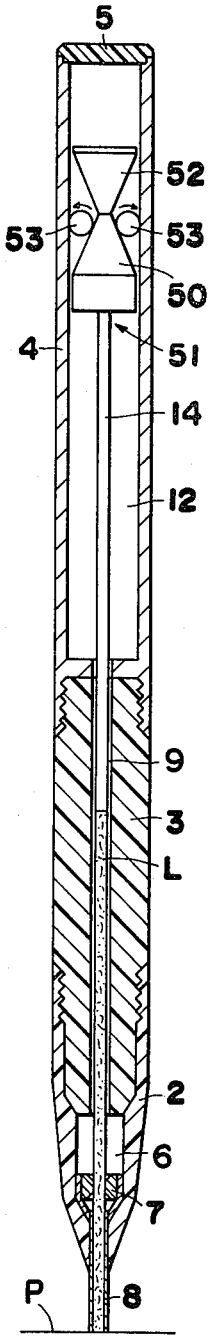

FIG. 7 shows a further modification of the lead clamp and the locking device which are illustrated at 21 and 23, respectively, in FIG. 4. The structure of FIG. 7 has a function to prevent the lead L from projecting unexpectedly from the forward end of the lead guide tube 8 when, otherwise constructed, an accidental shock is applied to the pencil to cause the lead clamp 51 and the locking device balls 53 to move excessively. In FIG. 7, the lead clamp 51 has a rod 14, a tapered first slide member 50 and a second slide member 52 which is tapered in a direction opposite to the tapered direction of the first slide member 50. The tapered ends of the slide members 50, 52 are coaxially connected together as illustrated. As is similar with the structure of the previous embodiments of the invention, the slide members 50, 52 are of substantial frusto-conical shape and have a maximum outer diameter which is smaller than the inner diameter of the rear end member 4 so that the slide member can be moved longitudinally within the rear end member 4. Balls 53 are disposed between the tapered end portions of the slide members 50, 52 and the inner surface of the rear end member 4. It will be readily understood that more than two balls may be provided while only two balls are shown, and that two cylindrical rollers may replace the two balls. As described previously, it is preferred that the rear end member 4 is made of steel so as to avoid an undesired wearing on the interior of the rear end member 4 due to rotary movement of the balls 53.

In the structure shown in FIG. 7, when the pencil is placed into a writing posture wherein the lead clamp 51 is moved rearwardly relative to the barrel 1, the balls 53 move downward by their weight to contact with the tapered slide member 50 and the inner surface of the rear end member 4. When an upward force due to a writing pressure is applied to the lead clamp 51, the balls 53 are rotated in the directions shown by the arrows to cause a locking or wedging of the lead clamp 51 within the rear end member 4. Thus the lead L is placed into a fixed position. Accordingly, a suitable writing pressure of the pencil toward a writing surface such as a paper permits the lead L to contact with the paper in a desired manner for a writing operation. Excessive lead advancement can be avoided as described hereinafter. When an unusual shock is applied to the barrel 1, the engagement between the lead clamp 51 and the balls 53 is immediately released, and at the same time the lead clamp 51 moves forward. In this instance, balls 53 will contact with the tapered second slide member 52 immediately after they disengage from the first slide member 50. When the balls 53 contact the second slide member 52 as described, the balls 53 are pressed against the inner surface of the rear end member 4 by the action of the second slide member 52 to produce a wedging action which prevents the lead clamp 51 from moving downwardly. Here, the angle of the tapered surface of the slide members 50, 52 and the dimension of the balls 53 can be selected to attain an adjustment of the lead clamp movement. The wedging action, namely, engagement between the second slide member 52 and the rollers 53 is maintained since the lead clamp 51 is intended to move downward by its own weight, and therefore the lead clamp 51 is in a fixed position relative to the barrel 1. However, the wedging action as described above is readily disengaged by a writing pressure which is added to the lead L in case of writing since the lead clamp 51 is moved upward relative to the barrel 1. When the wedging action is released, the balls 53 leave the second slide member 52 and contact again the first slide member 50 to thereby produce a new engagement between the balls 53 and the first slide member 50 to lock and prevent rearward movement of the lead clamp 51. Thus, the pencil is now ready for a writing operation.

Figure 8:
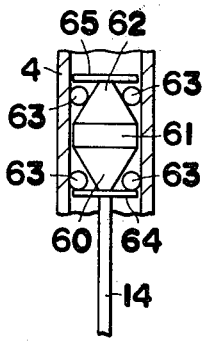
FIGS. 7 and 8 are sectional views of a mechanical pencil according to another embodiment of the invention, showing a device for releasing locking of the lead.

FIG. 8 shows a modified structure of the pencil, particularly of the lead clamp 51 and locking device (i.e., two balls 53) of the embodiment shown in FIG. 7. In FIG. 8, the lead clamp 61 has two frusto-conical slide members 60, 62 with their enlarged ends being fixed together, a first brim 64 between the tapered end of the first slide member 60 and the bar 14, and a second brim 65 atop the tapered end of the second slide member 62. In this structure four balls 63 are employed each of which is rotatably disposed in a space contoured in cross section by the tapered surface of the slide members 60 and 62, brims 64 and 65, and the inner surface of the rear end member 4. Other structures and operations are quite similar to those of the previous embodiments of the invention, and thus further detailed description thereof will not be made.

Figure 9:
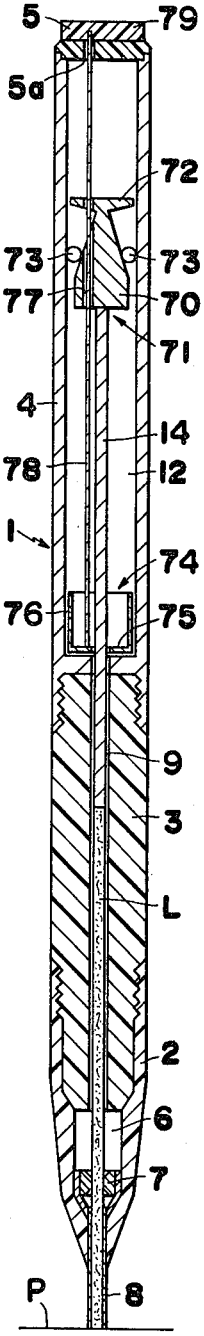
FIG. 9 is a sectional view of a part of a mechanical pencil, showing a modified structure of a lead locking device.
Figure 10:
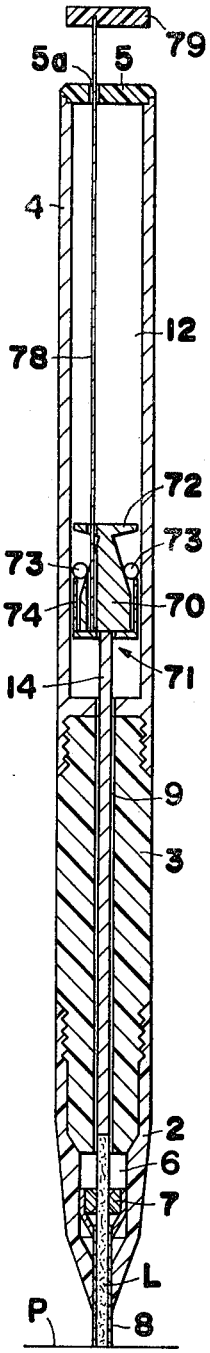
FIG. 10 is a sectional view of a part of a mechanical pencil, showing a further modified structure of the lead locking device.

Referring now to FIGS. 9 and 10 which show another embodiment of the invention, additional elements are provided within the rear end member 4 of the barrel 1 which is substantially similar to those of the previous embodiments. Briefly, provision of the additional elements, which will be described hereinafter, is for the purpose of easy disengagement of the lead L as well as easy supply of additional leads.

Within the tubular rear end member 4 of the barrel 1, the latter being of construction similar to those of the previous embodiments, a lead clamp 71 having a rod 14 and a frusto-conical slide member 70 and balls 73 is mounted movably in the lengthwise direction. The slide member 70 has a brim 72 integrally formed thereto at the top of the tapered end of the slide member 70. Within the rear end member 4 is also disposed a disengagement member 74 of a cup shape for disengaging the fixed position of the lead clamp 71. The disengagement member 74 is positioned lower than the slide member 70 and is slidable lengthwise within the rear end member 4. The disengagement member 74 has a hole 75 at the center of its bottom for freely inserting therethrough the rod 14 of the lead clamp 71, and a round shaped wall 76 by which a wedging action, namely, an engagement among the tapered slide member 70, balls 73 and the inner surface of the rear end member 4 is released when the disengagement member 74 is lifted upward to the extent that the wall 76 presses the balls 73 upwardy. The slide member 71 is provided with a hole 77 formed along an axis of the member 71 while the disengagement member 74 is provided with a connector rod 78 or otherwise a rigid steel wire which is connected to the bottom of the disengagement member 74 and extends upward through the hole 77 of slide member 70. The connector rod 78 extends further and passes through a hole 5*a* of the end cap 5. An upper end of the connector rod 78 is fixed to or anchored within a button 79 placed on the end cap 5.

The structure shown in FIG. 9 is advantageous particularly when additional leads should be supplied into the pencil. An operation of the pencil will be described with reference to FIG. 10 in a case that the lead clamp 71 should be fully retracted when, for example, a lead L is completely worn due to a lengthy writing operation or when the lead L is replaced with another lead for some reason. When the button 79 lifted upward by a finger-tip manipulation to move the connector rod 78 as well as the disengagement member 74 in the rearward direction, the wall 76 of the disengagement member 74 will abut against balls 73 to forcibly release the engagement between the tapered slide member 70, balls 73 and the inner surface of the rear end member 4. A further retracting movement of the disengagement member 74 will cause the bottom of the member 74 to contact the bottom of the slide member 70 and will make it possible to move the lead clamp 71 rearwardly. Thus, a rearward movement of the lead clamp 71 for the purpose of supplying new lead can be realized.

Although the illustrated disengagement member 74 is operated by means of the connector rod 78 and the button 79, an operation equivalent to the above can be made by forming a longitudinal slot on the rear end member 4 and an operation rod extending from the wall 76 of the disengagement member 74 through the thus formed longitudinal slot so that a sidewise operation may be conducted. If the disengagement member 74 has a weight great enough to release the balls 73 which have been engaged with the slide member, the aforementioned connector rod 78 and the button 79 can be omitted.

The structure shown in FIGS. 9 and 10 permits an easy rearward movement of the lead clamp 71, and therefore can empty the lead from the slot 9 to permit a smooth and easy operation of lead-supply into the slot 9.

Figure 11:
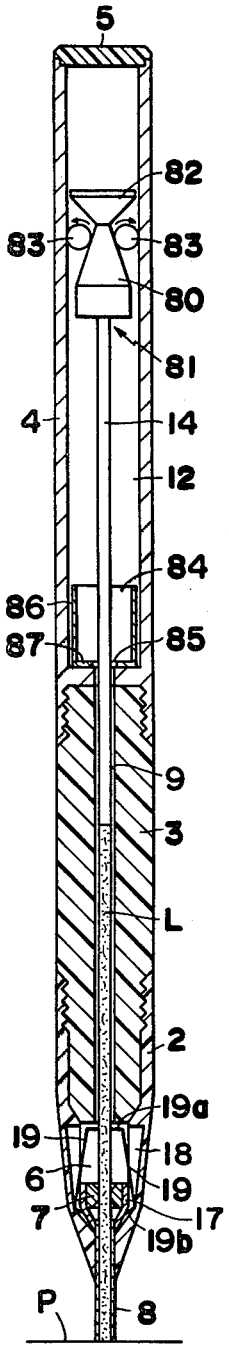
FIG. 11 is a sectional view of a mechanical pencil according to another embodiment of the invention, in which the lead is shown to be clamped by accidental advancement of a lead guide tube.

FIG. 11 shows a mechanical pencil according to another embodiment of the invention, in which excessive lead advancement due to an accidental outer force or shock applied to the pencil can be prevented. The pencil has a barrel body 1 including a forward end member 2, middle member 3 and rear end member 4 for forming a shape of the pencil substantially similar as that of the structure shown in FIGS. 1 through 3. As will be understood from the drawing as well as the description with reference to FIGS. 1–3, the lead holder 7 made of a resilient material to lightly hold the lead L and the lead holder housing 17 connected to the lead guide tube 8 are mounted slidably lengthwise within the bore 6 of the forward end member 2. The forward end member 2 has a plurality of grooves 18 formed radially on the inner surface of the member 2 with a constant interval therebetween, and a plurality of hooks 19 each of which has barbed ends 19*a*, 19*b* each projecting toward an axis, namely lead L, of the pencil. The hooks 19 are secured in the grooves 18 such that the rearward barbed end 19*a* of each hook can move toward the axis of the pencil. Namely, the hooks 19 are mounted in such a manner that they rotate about a curved point of the forward barbed end 19*b* to thereby enable the rearward barbed end 19*a* to engage with the lead L when the lead guide tube 8 is moved forward to contact with the forward barbed end 19*b*.

The middle member 3 has a through-hole for slidably securing therein the lead L in a manner similar to the structure of the previous embodiments. In the space 12 contoured by the cylindrical rear end member 4 which is threadedly, or otherwise in a press-fit manner, connected to the middle member 3, a lead clamp 81 as well as a locking device consisting of rotatable members such as balls 83 are mounted movably in the lengthwise direction of the pencil. The lead clamp 81 has a slide member having a first frusto-conical member 80 and a second frusto-conical member 82 with the tapered ends thereof being fixed together. The lead clamp 81 has also a rod 14 extending downwardly from the lower end of the first frusto-conical member 80 such that the other end of the rod 14 is slidably movable in the through-hole 9 of the middle member 3 to engage with or contact the lead L. Also slidably mounted in the space 12 of the rear end member 4 is a disengagement member 84 for releasing the engagement of the lead clamp 81 in a position of coaction of the tapered first slide member 80, balls 83 and an inner surface of the rear end member 4. The disengagement member 84 is cup-shaped and has a wall 86 and a bottom 87 with an axial hole 85, but it may be formed with a cylindrical wall only. The disengagement member 84 in the illustrated embodiment is designed to have a weight sufficient to forcibly release the aforementioned engagement of the tapered first slide member with the balls or rollers 83. Of course, it may be designed to have some elements such as the connector rod 78 and button 79 as described with reference to FIGS. 9 and 10.

The operation of the pencil, particularly of the hooks 19, will be described. When the pencil is placed in a writing position to thereby move the lead guide tube 8 rearwardly, the lead guide 8 is disengaged from the forward barbed end 19*b* of the hook 19, thereby permitting an engagement between the rearward barbed end 19*a* and the lead L. Further, the rearward movement of the lead guide tube 8 enables its rear end to urge the hooks 19 outwardly from the lead L so that the lead L may be disengaged from the rearward barbed end 19*a*. When a writing operation is finished and the pencil is lifted upward so that the lead and the lead guide tube 8 are isolated from the paper P, the lead L as well as the lead guide tube 8 move downward by their own weight since no force is added to these elements. Then, the rear end portion of the lead guide tube 8 contacts the forward barbed end 19*b* to pivot the hook 19 so that the lead L is engaged again with the rearward barbed end 19*a*. Thus, provision of the hook 19 as described above can prevent the lead L from being advanced, or more forward, excessively even if an accidental shock or force is applied to the pencil. Further, since the lead guide tube 8 holds the lead L softly by way of the lead holder 7 made of a resilient material, the lead guide tube 8 is retracted smoothly to permit a desired writing operation. Other operational modes as well as functions of the elements are similar to those of the previous embodiments and further detailed description thereof will not be made.

Figure 12:
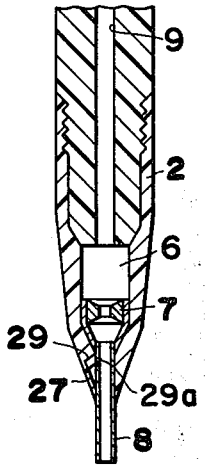
FIG. 12 is a sectional view of a part of the mechanical pencil illustrated in FIG. 11, showing a further modified structure.

FIG. 12 shows a modification of the pencil illustrated in FIG. 11. In this modified structure, a member 29 having a projection 29*a* is pivotably secured in a groove formed on an inner forward surface of the forward end member 2 while a lead guide tube 8 has a slot through which the projection 29*a* is extendable towards the axis of the lead guide tube 8. This structure can also engage the lead L in position even if an accidental shock or the like is applied to the pencil.

Figure 13:
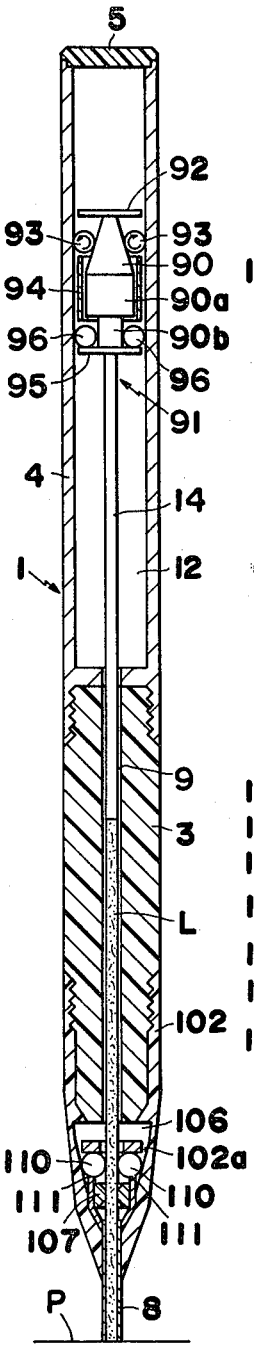
FIG. 13 is a sectional view of a mechanical pencil according to another embodiment of the invention.

FIG. 13 shows a mechanical pencil according to another embodiment of the invention. The pencil according to this embodiment is substantially similar in structure and operation to the foregoing embodiments, particularly the pencil shown in FIG. 11, except for the specific structure as set forth hereinafter. A lead clamp 91 is mounted movably lengthwise within the tubular rear end member 4. The lead clamp 91 has a slide member 90 of frusto-conical shape with a first portion 90*a* which has a diameter equivalent to that of the lowermost portion of the frusto-conical slide member 90, and with a second portion 90*b* which has a diameter much smaller than that of the first portion 90*a*. The lead clamp 91 is also provided with a first brim 92 on top of the tapered end of the frusto-conical slide member 90, a second brim 95 at the bottom of the second portion 90*b*, and a rod 14 which has been described with reference to the aforementioned various embodiments. A locking device formed with rotary elements such as balls 93 or rollers is mounted as illustrated. Within an annular space substantially confined by the second portion 90*b* and the inner surface of the rear end member 4, there are provided spherical rotary members such as balls 96 which are rotatably supported on the second brim 95. The reference numeral 94 designates a disengagement member of cylindrical shape, function and operation of which will be understood from the foregoing description which has been made with reference to FIGS. 9 and 10. The disengagement member 94 is slidably mounted between the balls 93 and the spherical rotary members 95, as illustrated. The spherical rotary members 95 (i.e., balls) are provided for the purpose of maintaining a regular position of the slide member 90 of the lead clamp 91 throughout its lengthwise movement relative to the barrel 1.

A forward end member 102, which is similar to the forward end member 2 of the previous embodiments and is connected to the middle member 3, has a bore 106 for slidably mounting therein a lead holder 107 of a resilient material and spherical members 110. The spherical members 110 are held in recesses 111 formed on top of a lead holder housing 107, the housing being connected to the lead guide tube 8. As is shown in FIG. 13, the bored forward end member 102 has an inner wall 102*a* which inclines downwardly toward the axis of the pencil so that a downwrd or forward movement of the spherical members 110 will relatively firmly hold the lead L. Thus, the lead can be held in safe manner even if an accidental shock or the like is applied to the pencil. Though the illustrated embodiment has two spherical members 110 symmetrically mounted within the bore 106 relative to the lead L, three spherical members or more can be mounted at a constant circumferential interval. It will be understood from the foregoing that the operational mode is similar to that of the previous embodiments, and that the spherical members 110 freely rotate in case of a rearward movement of the lead guide tube 8 relative to the barrel 1. Also it will be understood that when a writing pressure is released from the lead guide tube 8, the lead guide tube 8 as well as the lead holder 107 moves downwardly by their own weight with the lead L being held by the lead holder 107, and the spherical members 110 rotate to move downwardly along the inclined inner surface 102*a* of the forward end member 102, thereby engaging the lead L at their lowest position. Further, it will be understood that a new lead can be readily supplied by merely placing the pencil upside down to permit the lead clamp 91 to move toward the end cap 5, wherein the lead clamp 91 can be disengaged from the balls 93 by movement of the disengagement member 94 against the balls 93.

Figure 14:
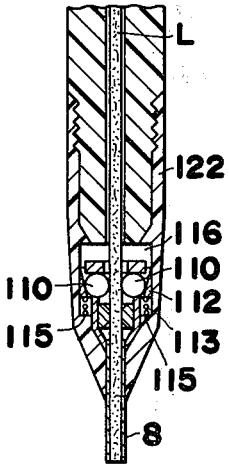
FIG. 14 is a sectional view of a part of a mechanical pencil, showing a further modified structure.

FIG. 14 shows a modified structure of the pencil described with reference to FIG. 13. In this modification a ring 112 and a spring 113 are mounted in a bore 116 of a forward and member 122. The ring 112 has a upwardly inclined inner surface, which corresponds functionally to the inclined inner surface 102*a* of the forward end member 102 of FIG. 13, and is biased upward by the spring 113 secured on a shoulder 115 of the bored forward end member 122. The spring 113 has a function to absorb a rapid movement force of the spherical members 110, the rapid movement of the spherical members 110 being likely to damage the lead L when the lead guide tube 8 moves forwardly.

Figure 15:
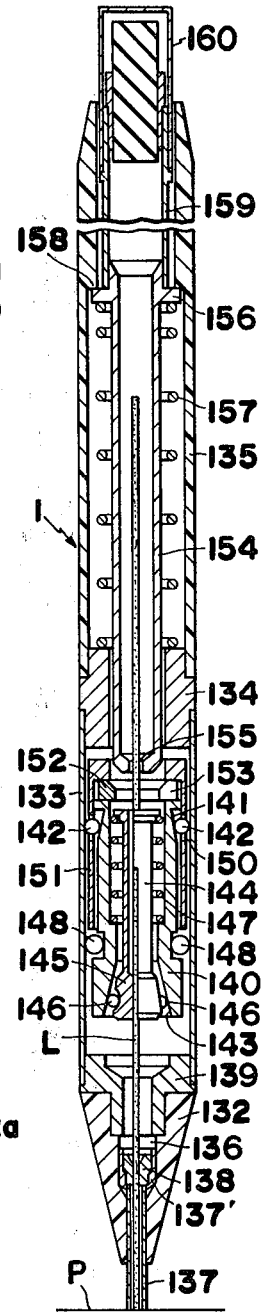
FIG. 15 is a sectional view of a mechanical pencil according to a further embodiment of the present invention, in which the lead is advanced by merely detaching a writing tip of the pencil from a writing paper or otherwise by moving the pencil in the lengthwise direction thereof.

FIG. 15 shows a mechanical pencil according to another embodiment of the invention, in which the lead can be advanced for the purpose of writing by releasing a writing tip of the pencil from a paper or the like, or by moving or swinging the pencil lengthwise. The pencil has a piece of barrel body 1 having a forward end member 132, middle member 133, rearward member 135 and connector 134 for connecting the middle member and the rearward member 135 together. These elements are illustrated to be axially connected by press-fitting, but may be threadedly engaged. The forward end member 132 has a bore 136 for slidably mounting a lead guide tube 137, lead holder 138 of resilient material and a lead holder housing 137' which corresponds to the lead holder housing illustrated at 17 in FIG. 1. The lead holder housing 137' holds therein the lead holder 138 and is connected at its lower end to an upper and of the lead guide tube 137. A stopper 139 is mounted at the upper end of the forward end member 132 for limiting the upward (i.e., rearward) movement of the lead holder housing 137. The middle member 133 which is connected at its lower end to the forward end member 132 through the stopper 139 as illustrated is of cylindrical shape and mounts therein a cylindrical body 140.

The cylindrical body 140 has a rear portion 141, an outer surface of which inclines toward the axis as its extends upward. Within an annular space formed between the inclined rear portion 141 and the middle member 133, a rotary device such as balls 142 or rollers are rotatably mounted, the number of which may be selected through only two are illustrated. The cylindrical body 140 has at its forward portion a tapered inner wall 143, wherein the wall inclines toward the axis as its extends upward. Within the cylindrical body 140 is mounted a lead clamp 144, which has a collet chuck 145 or lead carrier for releasably gripping the lead L, such that the collet chuck 145 is contacted with the tapered inner wall 143 by way of balls 146. Between the cylindrical body 140 and the lead clamp 144 is disposed a spring 147 which has a function to urge the collet chuck 145 against the tapered inner wall 143. Numeral 148 represents spherical members mounted in an annular recess formed on the outer surface of the cylindrical body 140. Also disposed between the cylindrical body 140 and middle member 133 is a disengagement member 151 of a cylindrical shape for releasing engagement between the cylindrical body 140 and the balls 142. It will be recognized that the cylindrical body 140, balls 142, disengagement member 151 and spherical member 148 correspond to the slide member 90 of the lead clamp 91, balls 93, disengagement member 94, and spherical member 96, respectively, of the structure described with reference to FIG. 13. In the embodiment of FIG. 15, the disengagement member 151 has holes 150 for mounting the aforementioned balls 142.

Reference numeral 152 is a C-shaped ring having a cut-out 153. The C-shaped ring is designed to have an inner diameter smaller than an outer diameter of a tubular lead housing 154 which will be described in detail hereinafter. The lead housing 154 has a function to contain therein spare leads and is provided with a hole 155 at the bottom for supplying a lead, in turn, to the lead clamp 144 within the cylindrical body 140. The lead housing 154 has an outward projection 156 at its rearward end. Around the lead housing 154 is mounted a spring 157 which is contacted with the connector 134 and the outward projection 156 so that the lead housing 154 is spring-biased upwardly. Thus, the outward projection 156 is held in contact with a shoulder 158 formed on an inner wall of the tubular rear member 135.

The reference numeral 159 is an operation tube, the forward end of which is contacted with the outward projection 156 of the lead housing 154, and numeral 160 is a cap mounted at the upper end of the operation tube 159.

Operation of the pencil shown in FIG. 15 will be described, though it is similar to the operation of the previous embodiments and will be understood from the foregoing description. When the pencil is placed in a writing posture as illustrated, the lead guide tube 137 is pressed against the paper P to urge the cylindrical body 140 rearwardly by way of the lead L, lead clamp 144 and balls 146, and then the cylindrical body 140 is locked by the coaction of the balls 142 and the inner surface of the middle member 133 so that the cylindrical body 140 may not move rearwardly. Thus the lead L is fixed relative to the barrel 1. When a writing operation is continued, the lead guide tube 137 slides along the lead L and moves rearwardly by the extent to which the lead L is worn until the lead holder housing 137' contacts the stopper 139. This rearward movement of the lead guide tube will be interrupted if the writing operation stops before the guide tube end (i.e., lead holder housing 137') contacts the stopper.

When the writing operation is finished and the lead tip is moved from the paper, the force which has been applied to the lead L, lead clamp 144, balls 146 and cylindrical body 140 is released, and immediately the cylindrical body 140 is unlocked. At the same time, the lead guide tube 137 moves forward by its own weight while holding the lead L until it is placed at its predetermined lowermost position within the bore 136. Successive writing operations can be carried out by placing the pencil such that the lead L as well as the guide tube 137 is pressed against the paper, as described above.

In order to release the disengagement between the cylindrical body 140 and the balls 142, the disengagement member 151 is moved rearwardly by placing the pencil into an upside-down posture or otherwise shaking the pencil rearwardly.

The lead guide tube 137 is moved rearwardly in accordance with the rearward movement of the cylindrical body 140.

If it is designed that the distance or length of the rearward movement of the lead guide tube 137 is smaller than the distance of the rearward movement of the cylindrical body 140, the latter will move further after the movement of the lead guide tube stops by means of the stopper 139. In this instance, while the lead clamp 144 holding the lead L ceases its movement since the lead L is fixed relative to the barrel 1, the balls 146 move downward to decrease the grasping force of the collect chuck 146 of the lead clamp 144. Thus, lead clamp 144 slides along the lead L and moves rearwardly to thereby grasp a further rearward portion of the lead L. If, thereafter, the pencil is positioned with its writing tip projecting downward, the elements 140, 144, 142, and 151 and the lead L as well as the lead guide tube 137 move forward (downward) relative to the barrel 1 until the lead guide tube stops at its lowermost position. In this instance, the forward movement of the lead guide tub 137 is substantially equal, in distance or length, to that of the cylindrical body 140, and therefore the forward movement of the cylindrical body 140 is shorter than the rearward movement of the same. Accordingly, the forward movement of the cylindrical body 140 stops with a space between the body 140 and the stopper 139, as illustrated in FIG. 15.

Operation of the lead housing 158 for supplying a new lead to the lead clamp 144 will be explained. The cap 160 is pushed downward to forcibly move the lead housing 154 downwardly against the resilient force of the spring 157 so that the cylindrical body 140 is moved the way of the C-shaped ring 152 to abut against the stopper 139. A further pushing operation of the cap 160 forces the lead housing 154 to insert into the C-shaped ring 152 against its radial resilient force and to press the end of the lead clamp 144, thereby moving the lead clamp 144 relative to the cylindrical body 140. In this instance, the lead L is held by the lead clamp 144 until the downward movement of the cylindrical body 140 stops, and the lead guide tube is in fixed position by means of the forward end member 132. Therefore, the lead L advances as long as the movement of the cylindrical body 140, and then the lead engagement by the lead clamp 144 is released.

After the lead housing 154 is fully moved forward, the lead housing 154 is retracted to the former position by the resilient force of the spring 157, by merely releasing the downward force added to the cap 160. At the same time, the C-shaped ring 152 and the disengagement member 151 are retracted to their position. By the rearward movement of the disengagement member 151, the engagement between the balls 142 and the cylindrical body 140 is released to permit the cylindrical body 140 and the lead clamp 144 to move rearwardly. Then the lead clamp 144 is moved rearwardly with the lead L being released, and the lead housing 154 is retracted further to its former position after it is released out of the C-shaped ring 152. Thus the lead clamp 144 holds again the lead L to complete the lead supplying operation. However, if desired, a new lead can be supplied from the lead guide tube 137 into the lead clamp 144 by merely adding a downward pressure onto the lead clamp so that the collet chuck 146 can be opened.

Figure 16:
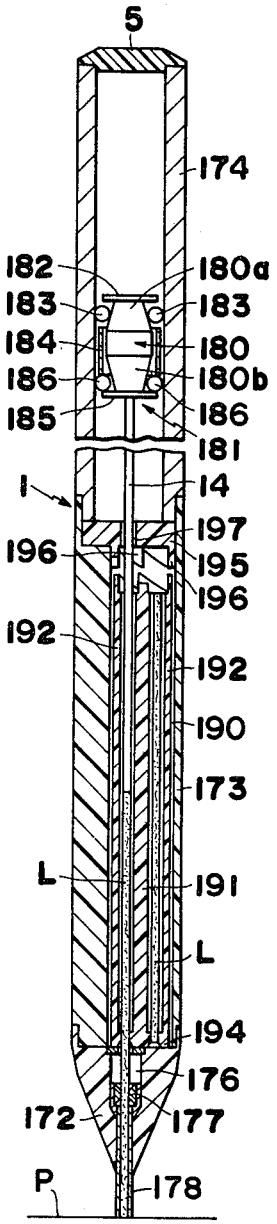
FIG. 16 is a sectional view of a mechanical pencil according to another embodiment of the invention, showing a revolver-type multi-lead housing.
Figure 17:
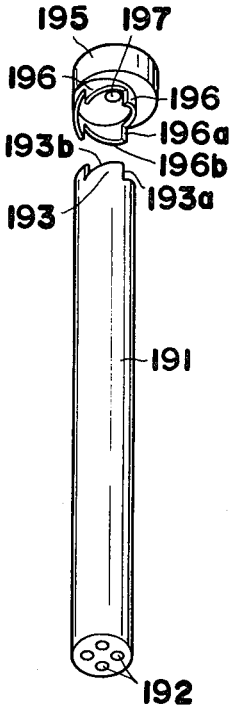
FIG. 17 is a perspective view of the lead housing and associated parts shown in FIG. 16.

FIGS. 16 and 17 show a mechanical pencil according to a further embodiment of the invention in which the lead can be supplied easily and continuously. As illustrated in FIG. 16, the mechanical pencil has a barrel body 1 having a forward end member 172, a middle member 173 and a rearward member 174. These members are press fitted to form a pencil casing as illustrated. The forward end member 172 has a bore 176 for slidably mounting therein a lead holder 177 and a lead guide tube 178. This structure is readily understood from the foregoing description of the previous embodiments of the inveniton as well as their function and operation, and a further detailed description thereof will not be made. Further, it will be understood that the devices mounted movably lengthwise within the rearward member 174 are quite similar to those of embodiment shown in FIG. 13. A lead clamp 181 has a slide member 180 having a first tapered portion 180*a* with a brim 182, a second tapered portion 180*b* and a rod 14. Reference numerals 183 and 184 are balls for locking the position of the lead clamp 181 and a disengagement member for releasing the locked position of the lead clamp, respectively. The numeral 186 indicates other balls which are provided for the purpose of maintaining the desired posture of the lead clamp 181. The balls 186 are rotatably disposed on a seat 185 of the lead clamp 181. The function and operation of these elements are quite understandable from the aforementioned, and no further description thereof will be made.

The pencil according to this embodiment of FIGS. 16 and 17 has a device within the middle member 173 which is not disposed in any of the foregoing embodiments. In FIGS. 16 and 17, the middle member 173 has a longitudinal bore 190 which is eccentric to the axis of the middle member. Within the eccentric longitudinal bore 190, there is provided a revolver 191 which is rotatable and movable lengthwise within the eccentric bore 190. The revolver 191 has a plurality of parallel slots 192 throughout its length for slidably securing therein leads L, and is mounted rotatably and movable lengthwise within the eccentric bore 190 so that any one of the slots 192 is axially aligned with the lead guide tube 178 when the revolver 191 is rotated. The revolver 191 has saw-shaped projections 193 each having aside end 193*a* parallel to the longitudinal side of the revolver and an upper end 193*b* which is inclined as illustrated. Further, revolver 191 has at its bottom or forward end lead ports 194 each having an inner diameter substantially equal to an diameter of lead L to softly contact the lead in position.

Within the rear end of the middle member 173, there is provided a guide disc 195 which is fixedly supported by the forward end of the rearward member 174. The guide disc 195 has a central hole 197 through which the rod 14 of the lead clamp 181 passes to engage with the lead L contained in one of the slots 192 of the revolver 191. Further, the guide disc 195 is provided with a plurality of saw-shaped protrusions 196 at a constant interval, each protrusion having a side end 196*a* and lower inclined side 196*a*. As illustrated, the saw-shaped protrusions 196 are formed in an eccentric manner with respect to the central hole 197 but concentric to the revolver 191. It will be understood from the foregoing that the projections 193 of the revolver 191 will match the protrusions 196 of the guide disc 195. Preferably, the number of these projections and protrusions is designed to be equal to the number of the slots 192, but not limited thereto.

Operation of the revolver 191 and the guide disc 195 for supplying new lead will be described. In order to supply a new lead after a lead which has been used is worn out, the revolver should be rotated so that the slot containing therein the new lead is aligned or registered with the lead guide tube 178. This is achieved by positioning the pencil upside down so that the revolver 191 is moved rearwardly or toward the guide disc 195. Thus, the projections 193 will abut against the protrusions 196 and immediately thereafter the projections 193 slide along the inclined sides 196*b* of the protrusions 196. Thus, the revolver 191 rotates as it goes toward the guide disc 195 by its own weight. The rotation of the revolver 191 as described above will cease when the side 193*a* of the revolver contacts with the side end 196*a* of the guide disc 195 so that the slot which contains a new lead is axially aligned with the lead guide tube 178. In this instance, the lead clamp 181 is also retracted toward the end cap 5 of the pencil, and the rod 14 which has been inserted into one of the slots 192 is removed from the slot 192.

After the revolver 191 is rotated as described above, if the pencil is positioned with its writing tip projecting downward again, the engagement between the revolver 191 and the guide disc 195 is released and, at the same time, the lead clamp 181 moves forwardly by its own weight and the rod is inserted into the slot 192 which contains a new lead to thereby forcibly rotate the revolver 191 to an adjusted position. After that, the forward end of the lead clamp 181, i.e., the rod, contacts to the new lead L to place the pencil into a writing posture as shown in FIG. 16. New leads can be supplied repeatedly by repeating the aforesaid operation.

In the embodiment described above, the revolver 191 is rotated by means of the cam mechanism, namely saw-shaped projections 193 coacted with the saw-shaped protrusions 196 of the guide disc 195, by the cam mechanism can be formed at the other positions of the elements. For example, cam grooves may be formed on the outer surface of the revolver 191 while projections may be provided on an inner surface of the barrel body 1 for slidably engaging with the cam grooves.

The operation of the lead advancing mechanism is quite similar to the aforementioned previous embodiments of the invention and will be understood from the descriptions thereof and further detailed description thereof will not be made.

Figure 18:
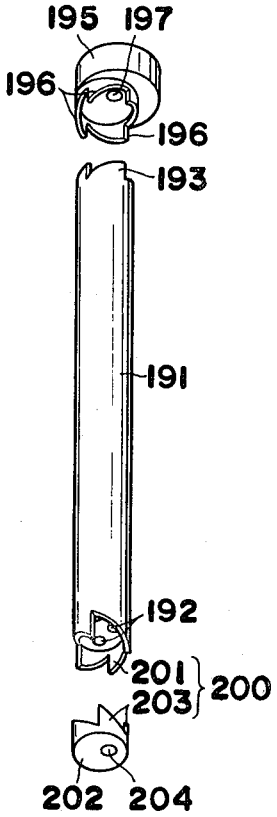
FIG. 18 is a perspective view of a modified form of the lead housing shown in FIG. 17.

FIG. 18 shows a modification of the pencil described with reference to FIGS. 16 and 17, in which an additional cam mechanism 200 is formed at the forward end of the revolver 191. In this modified structure, the revolver 191 has at its forward end a plurality of saw-shaped teeth 201 which are quite similar to the projections 193 formed at the rearward end of the revolver. A guide device 202 having teeth 203 is fixed within the forward end of the eccentric bore 190 (FIG. 16) so that it can coact with the teeth 201 of the revolver 191. In this structure, there is a phase lag between the first cam mechanism (193 and 196) and the second cam mechanism 200. Namely, if the projections 193 and teeth 201 are aligned in phase, the protrusion 196 of the guide disc 195 is staggered relative to the teeth 203 of the guide device 202. However, the projections 193 and teeth 201 may be staggered while the protrusions 196 are aligned with the teeth 203 of the guide device 195. Reference numeral 204 represents a hole which is formed in alignment with the axis of the aforementioned lead guide tube 178, see FIG. 16.

According to the pencil illustrated in FIG. 18, when one of the cam mechanism is in engagement, the other cam mechanism is released, and therefore the pencil presents the following operational mode. When the pencil is positioned in a writing posture with its writing tip projecting downward, the second cam mechanism, i.e., the teeth 201 and the teeth 203, are engaged while the first cam mechanism (i.e., projections 193 and protrusions 196) are disengaged. The projections 193 of the revolver 191 are staggered or shifted relative to the protrusion 196 of the guide disc 195. In order to supply a new lead after the lead is worn out or used fully, the pencil is positioned upside down to thereby move the revolver 191 by its weight. When the revolver is retracted, the second cam mechanism 200 is disengaged and then the first cam mechanism (193 and 196) is engaged. In this instance, since the projections 193 are staggered relative to, or different in phase from, the protrusions 196, the former (193) will slide along the inclined sides of the latter (196). Thus, the rotation of the revolver 191 is partially established. At this time, the teeth 201 of the revolver 191 are staggered relative to the teeth 203 of the guide device 202.

When the pencil is positioned again with its writing tip projecting downwardly, the revolver 191 again moves forwardly with the first cam mechanism (193 and 196) being released, and the second cam mechanism 200 is then engaged. Since the teeth 201 are staggered relative to the teeth 203 as described above, the teeth 201 of the revolver 191 will slide along the inclined sides of the teeth 203 of the guide device 202. Accordingly, the revolver now is rotated by "one pitch" of the teeth 203. Thus, the slot containing a new lead becomes axially aligned with the lead guide tube 178 (FIG. 16) for supplying the new lead to the lead guide tube 178.

Provision of the second cam mechanism 200 as described above will ensure a reliable and smooth rotation of the revolver for the purpose of supplying a new lead.

Figure 19:
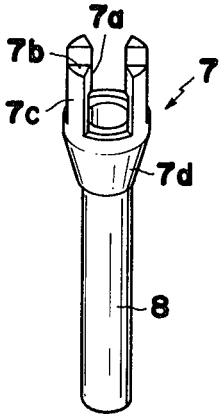
FIG. 19 is a perspective view of a preferred structure of the lead guide tube and lead holder employed in the inventive mechanical pencil, showing the lead holder having edges for nonrotatably holding the lead.

Though the present invention has been described with reference to various preferred embodiments thereof, many modifications and alterations may be made. For example, with reference to FIG. 1 for the purpose of clarification, lead guide tube 8 may be designed to have a device for preventing the lead from disadvantageously rotating within the tube 8 during a writing operation. As shown in FIG. 19, the lead guide tube 8 slidably mounted within a bore 6 of a forward end member 2 has a lead holder 7 which has an annular base portion *7d* at its rearward end. The base portion *7d* has four column portions *7c* projecting upward from the base portion at a constant circumferential interval. Each column portion *7c* each has a substantially triangular shape in section as illustrated in FIG. 19 and has a supporting portion *7b* at its upper portion, the supporting portion having an inner edge *7a* for engaging the lead in a line-contact manner. It is preferred that the lead holder 7 be made of a suitable metal so as to have a desired durability with respect to the lead L. The lead holder 7 which is constructed as described above will not only softly slidably hold the lead lengthwise but also will prevent the lead from rotating within the lead holder 7 and the lead guide tube 8 since the lead is nonrotatably held by the four inner edges *7a* of the column portions *7c*, the latter having a rigidity against torsion.

Although the present invention has been described with reference to preferred embodiments thereof, many modifications and alterations may be made within the scope of the invention.

What is claimed is:

1. A self-feeding mechanical pencil comprising:

a substantially tubular casing having therein a longitudinal lead passage for slidably supporting a lead, a longitudinal space connected to a first end of said lead passage, and abore coaxially aligned with and connected to a second end of said lead passage;

lead holder means, mounted for longitudinal sliding movement with said bore, for frictionally grasping the lead;

lead guide tube means, connected to said lead holder means and mounted for longitudinal sliding movement therewith in said bore and projecting forwardly from an end of said casing, for forming a writing tip with the leading end of the lead;

means, mounted for longitudinal movement within said longitudinal space, operable by its own weight for abutting and feeding the lead through said lead passage, said abutting and feeding means including a portion having a tapered frustoconical outer surface and a longitudinal rod connected to said portion and extending into said lead passage and abutting the rear end of the lead;

locking means, movably positioned adjacent said tapered frusto-conical outer surface within said longitudinal space, for locking said abutting and feeding means, and thus the lead, in a fixed longitudinal position of said casing upon the application to the lead of an upward thrust due to writing pressure during a writing operation;

said lead guide tube means being operable, during a writing operation when the leading end of the lead is worn down, to move said lead holder means inwardly of said bore while maintaining frictional contact with the lead; and said locking means being operable, upon the removal of said upward thrust and the lifting of the lead and said lead guide tube means from a writing surface, to unlock said abutting and feeding means from said fixed longitudinal position of said casing, such that said abutting and feeding means moves downwardly by its own weight, thus causing said longitudinal rod to abut the rear end of the lead and move the lead downwardly within said lead passage, and thus causing the lead to move said lead holder means and said lead guide tube means downwardly within said bore until said lead holder means abuts a forward portion of said casing.

2. A pencil as claimed in claim 1, wherein said locking means comprises a plurality of longitudinal plates mounted slidably around said tapered frusto-conical surface.

3. A pencil as claimed in claim 1, wherein said frusto-conical portion has a brim at a tapered end thereof, and said locking means comprises a plurality of rotary members mounted within a space confined by said tapered frusto-conical surface and said brim.

4. A pencil as claimed in claim 3, wherein said rotary members comprise steel balls.

5. A pencil as claimed in claim 1, wherein said frusto-conical portion has a recess and a spring mounted within said recess, said spring contacting said longitudinal rod.

6. A pencil as claimed in claim 1, wherein said longitudinal rod is integral with said portion.

7. A pencil as claimed in claim 1, wherein said rod includes a curved portion for imparting thereto resiliency.

8. A pencil as claimed in claim 1, wherein said abutting and feeding means includes a first frusto-conical portion having a first tapered end, a second frusto-conical portion having a second tapered end, the first and second conical portions being connected together with said tapered ends thereof being fixed to each other, said longitudinal rod is connected to said first frusto-conical portion, said longitudinal rod being engageable with said lead within said lead passage, said locking means comprises a plurality of rotary members engageable with said first frusto-conical portion, and said rotary members comprises balls or rollers.

9. A pencil as claimed in claim 1, further comprising disengagement means for releasing mechanically said locking means.

10. A pencil as claimed in claim 9, wherein said disengagement means comprises a cylindrical body movably mounted within said casing, said cylindrical body being movably lengthwise by its own weight to thereby release engagement of said locking means.

11. A pencil as claimed in claim 1, further comprising a plurality of hooks contacting with said lead guide tube means to thereby lock the movement of the lead.

12. A pencil as claimed in claim 1, further comprising a plurality of rotary members, coacting with said lead guide tube means, thereby firmly hold the lead to lock the movement of said lead.

13. A pencil as claimed in claim 1, further comprising a cylindrical lead housing having a plurality of longitudinal slots for securing therein spare leads, said lead housing being mounted rotatably about its axis and slidably lengthwise within said casing, said lead housing being eccentrically mounted with respect to the center axis of said casing such that said slots can be aligned axially with said lead guide tube means when said lead housing is rotated, said lead housing having at one end thereof a guide device, whereby when said lead housing is moved in contact with said guide device, said lead housing is rotated by and then engaged with said guide device, thereby aligning one of said slots with said lead guide tube means.

14. A pencil as claimed in claim 13, wherein said guide device comprises a disc mounted fixedly within said casing, said disc having a plurality of first spaced teeth at a constant circumferential interval, and said housing has at a first end thereof a plurality of second teeth engageable with said first teeth of said disc.

15. A pencil as claimed in claim 14, wherein said housing has at a second end thereof a plurality of third teeth, and said casing has therein a plurality of fourth teeth, said third teeth being engageable with said fourth teeth, whereby when said lead housing is moved in contact with said fourth teeth, said lead housing is rotated such that one of said slots is aligned with said lead guide tube means.

16. A pencil as claimed in claim 1, wherein said lead holder means comprises a ring body connected to said lead guide tube means, and a plurality of columnar members projecting in parallel relation from said ring body, said columnar members each having an edge portion for slidably but nonrotatably holding the lead, thereby preventing the lead from rotating during a writing operation.

* * * * *